US005692451A

United States Patent [19]

Pastore

[11] Patent Number: 5,692,451

[45] Date of Patent: Dec. 2, 1997

[54] SEA CHEST COVERS

[76] Inventor: Joseph Pastore, 2816 West Crown Pointe Blvd., Naples, Fla. 33962

[21] Appl. No.: 421,549

[22] Filed: Apr. 13, 1995

[51] Int. Cl.[6] ..... B63B 39/03

[52] U.S. Cl. ..... 114/125

[58] Field of Search ..... 440/38, 46, 71, 440/72; 114/343, 221 R, 121, 125; 52/177

[56] References Cited

U.S. PATENT DOCUMENTS

| | | | |
|---|---|---|---|
| 3,035,538 | 5/1962 | Willard | 440/72 |
| 4,798,029 | 1/1989 | Carlton | 52/177 |

FOREIGN PATENT DOCUMENTS

| | | | |
|---|---|---|---|
| 1531732 | 1/1970 | Germany | 440/46 |

OTHER PUBLICATIONS

Fibergrate, Fibergrate Corporation, Dallas Texas, Lloyd's Ship Manager, p. 32, Nov. 1985.

*Primary Examiner*—Stephen Avila

*Attorney, Agent, or Firm*—Chris A. Caseiro; Thomas L. Bohan

[57] ABSTRACT

A sea chest cover for providing access to the sea chest of a ship. The sea chest cover is fabricated essentially entirely of one or more viscoelastic materials, preferably either polyethylene or polyurethane. Fabrication of the sea chest cover from a viscoelastic material reduces or eliminates corrosion and erosion problems. It also minimizes marine organism and ice build-up. The result is a reduction in the expense associated with maintaining such covers. The fabrication of the sea chest cover essentially entirely of viscoelastic materials minimizes the weight of such components, thereby making handling and maintenance easier. The sea chest cover is either pre-formed to a shape conforming with the shape of the ship's hull in the area where the sea chest is located, or it is sufficiently flexible to be placed into such conformance. The sea chest cover of the present invention may be formed as a unitary piece or as a plurality of removably connectable parts.

16 Claims, 2 Drawing Sheets

SEA CHEST COVERS

BACKGROUND OF THE INVENTION

1. Field of the Invention

The present invention relates to devices for covering hull water inlet and outlet compartments of water-going vessels, such compartments being commonly identified as sea chests. More particularly, the present invention relates to the covers of sea chests of such vessels. Still more particularly, the present invention relates to an improvement in the design of such sea chest covers so as to enhance the maintainability of such components. The present invention relates principally to fabricating sea chest covers of viscoelastic materials that can be formed into hull-conforming shapes when desired.

2. Description of the Prior Art

In most, if not all, water-going vessels, particularly ocean-going vessels, there are many areas of the hull that have superstructure compartments that receive and expel water. These compartments are known generally as sea chests. One example of a sea chest would be a compartment that houses ballast valving designed to regulate the flow of water into and out of ballast tanks for stabilization of the vessel. Another example is a compartment for maneuvering thrusters that cause water to be forced from the compartment. Yet another example would be a sea chest for housing sensors used to determine the speed of the vessel or the depth of the water below the vessel. If these valves, thrusters, sensors, or other types of equipment, which must be in contact with the water in order to operate correctly, were placed directly on the exterior of the ship's hull, they would be subject to catastrophic stresses from the water flowing by, from debris, or from any substantive structure that the hull might contact. It is therefore necessary to place such water-contacting equipment within a compartment—the sea chest—that can be filled with water but that is essentially protected by the ship's hull.

Sea chests may be placed in most any location on the ship's hull. They are accessed from the outside of the hull by one or more covers that are designed to conform essentially to the hull shape. These covers generally include a grate or a plurality of holes that permit water to enter or exit the sea chest, dependent upon the pressure differential between the sea chest interior and the hull exterior. Upon a stabilization of those pressures, any water within the sea chest is essentially stagnant, regardless of the water flow rate across the hull exterior. For the sea chests containing the maneuvering thrusters, water is typically ejected through hinged panels that act as the cover and that open to permit water to exit and that close to prevent water from entering.

When equipment within a sea chest must be repaired or otherwise worked on, the sea chest cover must first be removed. Over the very wide range of vessel sizes and shapes there are similarly many sea chests of different sizes and shapes. As a result, them are sea chest covers of many sizes and shapes. For relatively large ocean-going ships, the sea chest covers, which are presently all fabricated of metal—principally cast iron—can weigh several hundred pounds. Removal and replacement of the sea chest covers can therefore be a very difficult task-particularly when carried out underwater.

In addition to the present difficulty of handling these awkward, heavy pieces of metal when equipment within the sea chest must be accessed, is the difficulty associated with maintaining the covers themselves. Specifically, it is well known that metal surfaces of water-going vessels are subject to corrosion. That means that all water-contacting areas of the hull—including all surfaces of the sea chest covers—must be protected with some form of sealant. For the most part, that sealant is paint. Under the conditions typically experienced at sea, ship hulls must be painted fairy regularly. If they are not, the metal will deteriorate structurally, and the hydrodynamic profile of the ship will decline. This is a particular problem in the field of sea chest covers, where the grate, the hinged panels, or the plurality of holes include many sharp transition regions that are subject to considerable water flow rates and where it is extremely difficult to keep the paint attached to the metal. As a result, maintenance designed to prevent corrosion of sea chest covers is virtually a continuous process.

Another problem associated with metal components in water is that of erosion—the removal of metal particles from such components caused by the flow of water and foreign particles contained in the water. Over a period of time, exposed metal may be eroded enough to require replacement of the component. While this problem is of somewhat limited concern for most sea chest covers—a notable exception being the hinged thruster panels—it is nevertheless a problem common to metals underwater that must occasionally be addressed.

A problem related to the fabrication of metal hulls generally, and metal sea chest covers in particular, is that of the attachment and growth of water-borne organisms. At a microscopic level, the relatively rough metal surfaces make for excellent attachment sites for such organisms. That attachment typically occurs when the water is stagnant. It is therefore less often a problem at the exterior of the ship's hull than on the interior of a sea chest compartment. If such growth, which can be quite rapid, is permitted to continue, the hydrodynamic profile of the vessel declines and the underlying metal becomes much more difficult to clean. For the sea chest covers, these problems are compounded by the additional problem that the growth of such organisms will effectively close off the sea chest interior due to a clogging of the cover grate, panels, or holes. That problem alone may be the most significant in terms of the ability to maintain operation of the vessel, particularly when ballast valving is contained within the sea chest, or when thruster doors fail to swing open quickly. If the ability to maneuver the vessel is reduced, or if ballast adjustments cannot be made when required, the vessel may be critically affected—with sinking a possibility. In northern waters, the attachment of ice may create correspondingly similar problems.

In order to minimize the potential problems associated with corrosion and organism or ice growth on the sea chest covers, the covers must be inspected, removed, and repaired or otherwise overhauled on far too regular a basis. When such maintenance is done in dry dock, or in situ underwater, just the handling of these heavy pieces is extremely difficult. Added to that burden is the difficulty in removing corroded metal and/or the organisms or ice, and the necessary application of one or more new coats of paint. The time and expense involved in maintaining sea chest covers is therefore extremely high when compared to the time and expense required to maintain other areas of the hull. However, because the sea chest areas of ships are so critical to proper ship operation, it is essential that such maintenance be performed.

Yet another concern related to the use of metal components in watercraft is that of vibration. When a vessel moves through the water, turbulent flow rates impart vibrational energy to the vessel's hull, including the metal sea chest covers. Since there is little loss in the metal of the dynamic energy caused by the turbulent water flow, it can be transferred to other areas of the ship where the vibrations can cause operational difficulties. Additionally, the turbulence caused by rapid water flow around the sharp-transition areas of essentially square leading edges of grates and hinged panels of the prior covers can result in mechanical failure of their components. It can also reduce the available water flow rate. The lack of energy-absorbing capability—if not turbulence-minimizing means—is a particular problem in ships where it is desirable to avoid the transmittal of sound waves back from the ship to the surrounding water.

Therefore, what is needed is a sea chest cover that minimizes or eliminates corrosion build-up as well as the effects of metal erosion. What is also needed is a sea chest cover that minimizes or eliminates the problems associated with organism and/or ice attachment thereto. Further, what is needed is a sea chest cover that is easier to handle than presently-existing metal sea chest covers. Still further, what is needed is a sea chest cover that reduces the creation and/or transmission of vibrational energy. Finally, what is needed is a sea chest cover that is easier to maintain than presently-existing metal sea chest covers.

SUMMARY OF THE INVENTION

It is an object of the present invention to provide a sea chest cover that is much lighter and therefore much easier to manipulate than existing sea chest covers. It is also an object of the present invention to provide a sea chest cover that effectively eliminates the problems of organism and/or ice build-up plaguing present sea chest covers. It is yet another object of the present invention to provide a sea chest cover that will not corrode nor be easily eroded and will therefore extend the required-maintenance cycle. Still another object of the present invention is to provide a sea chest cover that minimizes the turbulence of water flowing passed it and that reduces the transmission of vibrational energy from the cover to the cover's surroundings.

These and other objectives are achieved in the present invention by eliminating most, if not all, of the metal components of present sea chest covers and replacing those components with one or more parts made essentially entirely of one or more viscoelastic materials. The cover may be fabricated of any of a variety of tough viscoelastic materials that have some flexibility along with sufficient strength to withstand the loads experienced while underwater. Viscoelastic materials considered to be suitable include, but are not limited to, polyurethane, polyethylene, polypropylene, flexibilized epoxy, and co-polymer combinations such as polyethylene-polypropylene. In particular, polyethylenes, polyurethanes, and the other viscoelastics noted, that have a Shore hardness in the range from 60A to 95D are generally sufficient to be used in the formation of the sea chest covers of the present invention.

The viscoelastic materials contemplated for use in this application are strong enough to absorb most of the abuse typically inflicted on the hull of a ship. They are much less dense than metals, and for a given cross-sectional area are lighter. They also present a much smoother surface profile in comparison to the profile provided by metal components. The smooth surface profile restricts ice and marine organism build up. When such build up occasionally occurs, the smooth surface of the formed viscoelastic components of the present invention permits easy removal of those undesirable elements.

It is well known that viscoelastic materials that are formulated to be tough, that is, viscoelastic materials that are not brittle and that do not fail completely when impacted, resist erosion well. These materials are also essentially corrosion resistant. Therefore, fabrication of the sea chest cover of the present invention from such viscoelastic materials will reduce the maintenance requirements that would otherwise be caused by the impact of particles within the water constantly hitting the ship's hull. It is also well known that viscoelastic materials absorb energy more efficiently than do elastic materials such as metals. Fabrication of the sea chest cover of the present invention from a viscoelastic material will therefore reduce the effects of vibrational energy in those areas of the hull.

The sea chest covers are typically formed as grates, as plates containing a plurality of holes, or as hinged panels. When a grate cover is required, the present invention includes a plurality of bars or rods that form a grid through which water may pass into or out of the sea chest. The bars or rods are connected to a cover ring that is detachably connected to the ship hull by any well known attachment means. The bars or rods may be connected either permanently to the ring such as by welding, or they may be removably connected using bolts, screws, and the like. The ring may be a flat piece or it may be shaped to conform to the particular profile of the hull in the region where it is to be placed. The bars, rods, and the cover ring may be separately fabricated of one or more of the viscoelastic types previously indicated. In the alternative, the plurality of bars or rods may be fabricated as a single piece, and may even be formed along with the cover ring during the same fabrication process. Satisfactory fabrication techniques include, but are not limited to, polymer casting, injection or compression molding, or by machining designed pieces from standard sheets of commercially available material.

When the sea chest cover is designed to include a plurality of holes, the cover may be formed as a single sheet shaped to conform to the hull shape. The plurality of holes may be drilled or punched out of the sheet, with the perimeter of the sheet acting as the cover ring to be attached to the ship's hull in the manner indicated for the grate-type cover. Alternatively, the cover ring may be a separate piece to be permanently or detachably connected to the cover sheet. The sea chest cover may also be fabricated with the plurality of holes formed during the fabrication process, such as by adding inserts into a mold used during the casting or injection-molding process.

Sea chest covers fabricated as hinged panels may be formed in a similar fashion. That is, the cover ring may be made as noted, and a plurality of molded or machined slats of viscoelastic material may be hingedly attached to the cover ring. The hinged attachment of the slats must be done so that water is permitted to move in only one direction through the sea chest. For example, in a sea chest containing bow thrusters, water is only permitted to exit the sea chest. When the thrusters are on, the hinged slats must be attached to the cover ring so that they swing outwardly to permit water exhaust. When the thrusters are off, the hinged slats must present a closed door appearance to prevent water from entering the sea chest. Attachment of the slats may be achieved by any well known means, including, but not limited to the placement of rods through the center of one end of a slat. The ends of the rods may be affixed to the cover ring to permit swinging of the slats.

As indicated, the sea chest cover of the present invention is fabricated essentially entirely of viscoelastic material. It may be formed as a single piece or as a plurality of permanently or detachably connected pieces. Preferably, the edges of the grate rods and bars, and of the hinged slats are molded or machined so as to present a smooth hydrodynamic profile. This design minimizes water flow turbulence. It therefore also enhances water flow rates and minimizes the creation of vibrational energy. The viscoelastic material may be reinforced with any suitable material, including non-metallic and metallic materials, as necessary for particular applications, provided essentially all exposed surfaces of the cover are viscoelastic material. In this way, corrosion and erosion effects are minimized, marine-organism and ice build-up are effectively reduced or eliminated, vibrational energy transmissions are reduced, and maintenance and handling are made easier.

These and other advantages of the present invention will become more readily apparent upon review of the accompanying drawings and detailed description of the preferred embodiment.

DETAILED DESCRIPTION OF THE PREFERRED EMBODIMENT OF THE INVENTION

Figure 1:
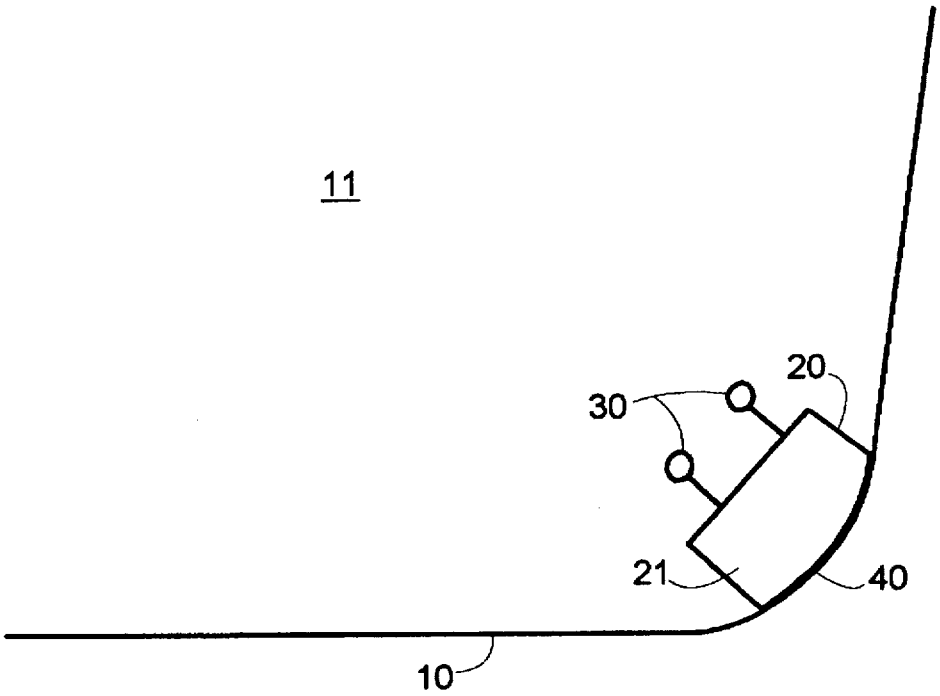
FIG. 1 is a simplified side view of a ship showing an exemplar sea chest with sea chest cover.

A sea chest cover 40 of the present invention is shown in FIG. 1 as forming part of a hull 10 of a ship 11 having a sea chest 20 that provides a water transference area 21 for ship equipment such as ballast valves 30 for example. The sea chest cover 40 is preferably designed to conform to the shape of the hull 10 in the region of the ship 11 where the sea chest 20 is located. Such conformance may be achieved either by pre-forming the sea chest cover 40 into the hull shape during the fabrication process, or it may be designed to be sufficiently flexible to be forced into shape conformance. The thickness of the sea chest cover 40 may be varied so as to comply with the particular ship for which it is to be used. It is contemplated that the overall thickness of the sea chest cover 40 may be in the range from ¼" to 3". As previously noted, the ship 11 may have a plurality of sea chests located fore and aft, and port and starboard, below its waterline. The sea chest 20 and the sea chest cover 40 shown in the FIGURES are exemplars of all such components. It is to be understood that this discussion of the preferred embodiment of the present invention may be applied to the wide variety of sea chest covers required, independent of specific shapes and dimensions.

Figure 2:
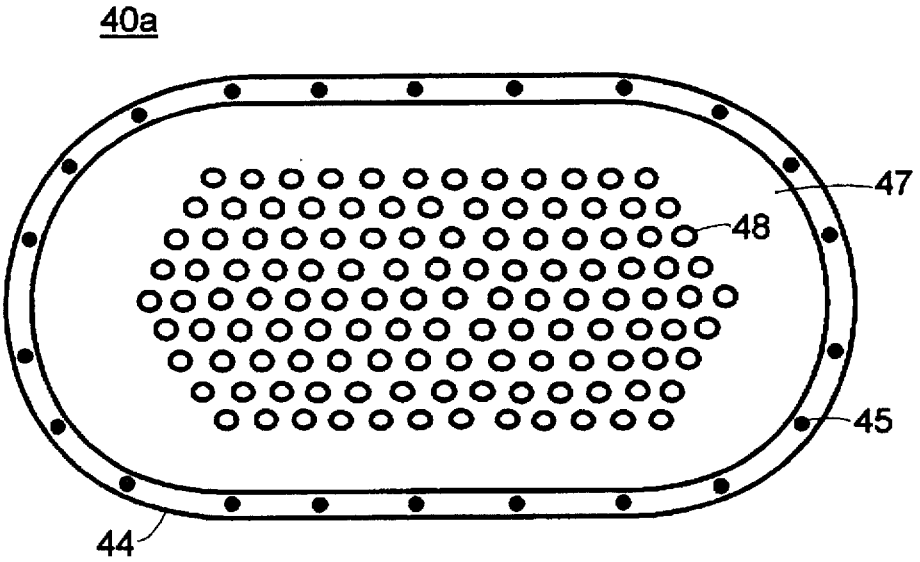
FIG. 2 is a front view of the sea chest cover of the present invention, showing the cover as a single piece having a plurality of inlet/outlet holes.

As illustrated in FIG. 2, a perforated sea chest cover **40*a* which includes a main cover body 47 and a cover ring 44 used to attach the perforated cover 40*a* to the hull 10. The main cover body 47 includes a plurality of perforations 48 designed to permit water to flow into and out of the sea chest 20. The main cover body 47 and the cover ring 44 may be fabricated together as a unitary piece, or individually as two or more separate pieces. The perforations 48 may be machined, punched, or otherwise formed in the main cover body 47 after the main cover body 47 has been fabricated. In the alternative, the perforations 48 may be created during the fabrication of the main cover body 47, such as by adding inserts to a mold used to make the main cover body 47. The main cover body 47** is preferably fabricated by machining it from one or more pieces of pre-formed material in the Shore hardness range of 60A to 95D. A polyethylene having a Shore hardness of 68D, a flexural strength of about 125,000 psi, and an elongation of about 600%, has been found to be particularly suitable.

The main cover body 47 may also be fabricated by casting a thermoset liquid viscoelastic material into a preformed mold, allowing the liquid to cure, and removing the solid main cover body 47 from the mold for attachment to the hull 10. Of course, some or all of the components of the perforated cover **40*a* may be fabricated in this way, or they may be fabricated of a thermoplastic viscoelastic material that is injection molded, compression molded, pultruded, or otherwise produced in a manner known by those skilled in the art of viscoelastic part fabrication. Reinforcing materials such as fibers and fabrics made of glass, carbon, etc., may be used to strengthen the formulation with minimal effect on the toughness of the viscoelastic material. The molds used to produce the perforated cover 40*a* may be used to produce a flat piece or pieces that are subsequently forced to conform to the hull shape upon attachment. In the alternative, the molds may be designed to form the cover piece or pieces into hull-conforming shapes, thereby reducing stress on the cover. It is to be noted that some or all of the components of the grate-type cover 40*a*** may be fabricated in a similar fashion.

Figure 3A:
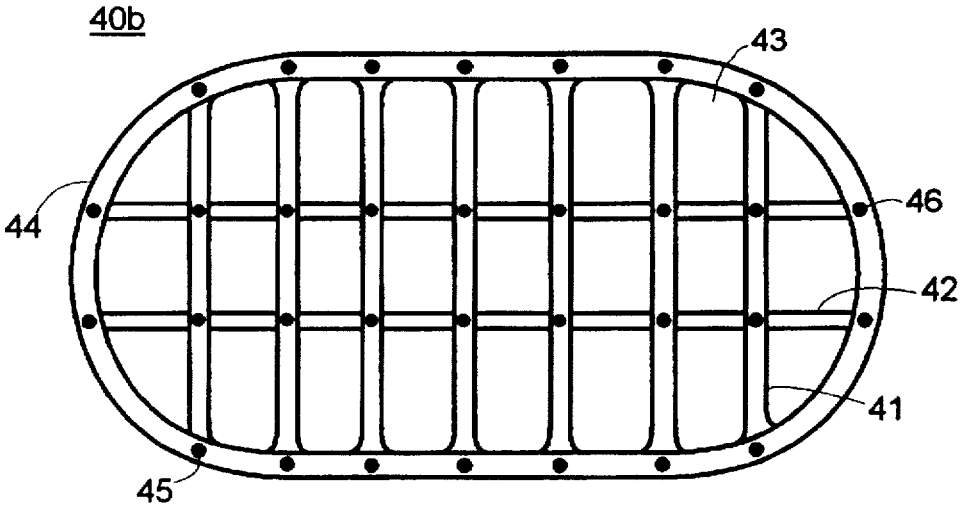
FIG. 3A is a front view of the sea chest cover of the present invention, showing the cover as a grate.

As illustrated in FIG. 3A, a grate-type sea chest cover **40*b* includes a plurality of transverse rods 41 and one or more longitudinal structural rods 42. More than one structural rod 42 may be required to provide sufficient strength to the cover 40*b*, depending upon the size of grate openings 43 required for the particular equipment located within the sea chest 20, as well as the size of the sea chest 20 to be covered. The transverse rods 41 and the structural rods 42 are connected to a cover perimeter region that is the cover ring 44 used to connect the cover 40*b* to the hull 10 of the ship 11. In the preferred embodiment of the present invention the transverse rods 41, the structural rods 42, and the cover ring 44 are fabricated as separate pieces that may be bonded, bolted, screwed, or otherwise connected together by some rod connecting means. The cover ring 44 is preferably detachably connected to the hull 10 by cover bolts 45 that may be placed in ring bolt holes 46 formed in the cover ring 44. The grate-type cover 40*b* is designed to fit into a recess ring of the hull 10 so that it is flush with the hull 10, thereby minimizing the hydrodynamic profile of the ship 11. The perforated cover 40*a*** may be affixed in a similar manner.

The transverse rods 41, the structural rods 42, and the cover ring 44 of the grate-type cover **40*b* are formed either completely, or essentially entirely, of one or more viscoelastic materials. Preferably, those components are fabricated of a single viscoelastic material, such as the polyethylene material described for fabrication of the perforated cover 40*a*. Alternatively, a polyurethane with a Shore hardness in the range from 60A to 95D, or a polyethylene of similar or greater hardness may be used. However, combinations of different viscoelastics, or different formulations of a single viscoelastic type, may be used to form the noted components. Use of more than one viscoelastic type, or more than one formulation of a particular viscoelastic may be necessary or desired, depending upon the particular sea chest or hull area involved. For example, one portion of the sea chest cover may have to be fairly flexible while another portion may have to be relatively rigid. The connecting means used to connect those components together may also be fabricated of a viscoelastic material, or they may be standard metal bolts, screws, etc. If metal connecting elements are used, viscoelastic plugs may be placed in the ring bolt holes 46** over those metal connectors as protective sealers.

Figure 3B:
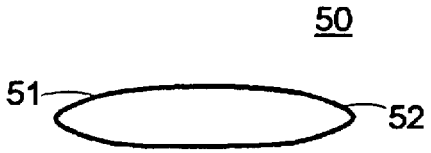
FIG. 3B is a side view of a bar or rod of the grate cover of FIG. 3A, showing the hydrodynamic profile of the bar or rod.

As illustrated in FIG. 3B, an exemplar grate rod 50 that may be either one of the transverse rods 41 or one of the structural rods 42 is preferably molded, machined, or otherwise fabricated with a hydrodynamic profile. Specifically, the grate rod 50 includes a first rod end 51 and a second rod end 52, both of which reduce water turbulence as the water passes through the grate cover **40*b* and either into or out of the sea chest 20**.

Figure 4A:
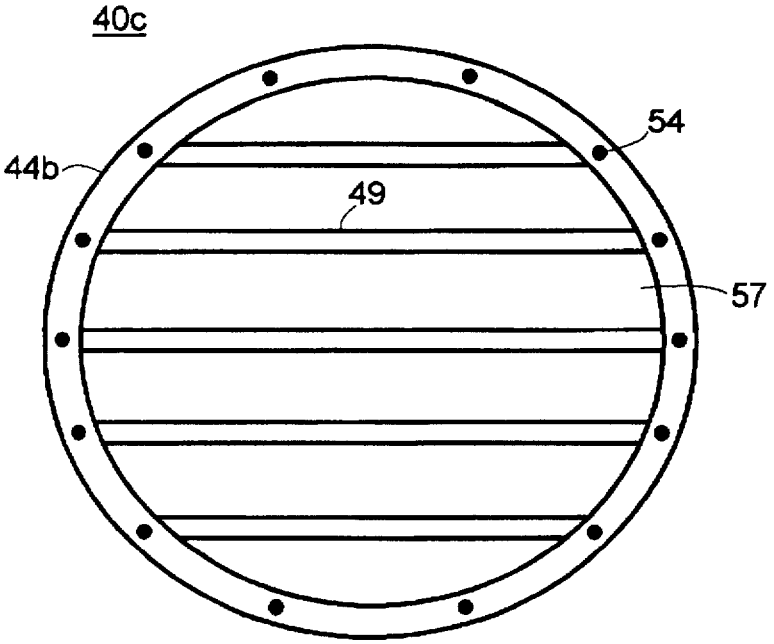
FIG. 4A is a front view of the sea chest cover of the present invention, showing the cover as a plurality of door slats.
Figure 4B:
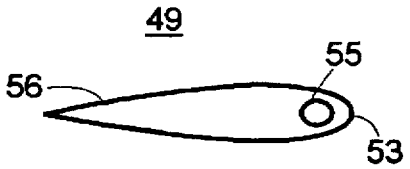
FIG. 4B is a side view of a slat of the cover of FIG. 4A, showing the hydrodynamic profile of the slat.

As illustrated in FIG. 4A, a hinged-slat sea chest cover **40*c* includes a plurality of slats 49 that may be hingedly attached to the cover ring 44*b*. As illustrated, the cover ring 44*b* may be formed in a round design. In the alternative, it may be formed in a shape similar to that of the perforated cover 40*a* and the grate cover 40*b*. The slats 49 are shown in FIG. 4A in a position permitting water flow. The hinged-slat sea chest cover 40*c* may be fabricated in the manner and with the materials indicated for the other cover types. As illustrated in FIG. 4B, the slats 49 are preferably formed with a hydrodynamic profile. Specifically, leading slat edge 53 is connected to the cover ring 44*b* with connecting means such as slat bolts 54. Alternatively, the leading slat edge 53 may be linked to the cover ring 44*b* with a hinge rod 55 permitting swinging of the slats 49. A trailing slat edge 56 is designed to swing freely so as to provide cover openings 57** for water exit.

Although the present invention has been described with particular reference to the preferred embodiment, it is to be understood that alternatives and equivalents in materials, design and methods may be made without departing from the spirit and scope of the invention.

I claim:

1. A sea chest cover designed to permit water into and out of a sea chest of a ship hull, wherein water within said sea chest may be stagnant, said sea chest cover comprising:

a. a perimeter component for removably connecting said sea chest cover to said ship hull, said perimeter component fabricated substantially of a uniform material that is a first viscoelastic material; and b. a water flow-through component couplable to said perimeter component, said water flow-through component fabricated of substantially of a uniform material that is a second viscoelastic material designed to restrict marine organism build-up thereon, wherein said perimeter component and said water flow-through component are fabricated in shapes designed to conform substantially with a profile of said ship hull where said sea chest is located, so as to maximize water flow through said sea chest cover.

2. The sea chest cover as claimed in claim 1 wherein said first viscoelastic material and said second viscoelastic material are polyethylenes.

3. The sea chest cover as claimed in claim 2 wherein said first viscoelastic material and said second viscoelastic material are the same polyethylene formulation having a Shore hardness in the range from 60A to 95D.

4. The sea chest cover as claimed in claim 1 wherein said first viscoelastic material and said second viscoelastic material are polyurethanes.

5. The sea chest cover as claimed in claim 4 wherein said first viscoelastic material and said second viscoelastic material are the same polyurethane formulation, wherein when cured, said polyurethane formulation has a Shore hardness in the range from 60A to 95D.

6. The sea chest cover as claimed in claim 1 wherein said water flow-through component is a grate comprising a plurality of transverse rods and one or more longitudinal structural rods.

7. The sea chest cover as claimed in claim 6 wherein said transverse rods and said structural rods are designed to provide a smooth hydrodynamic profile.

8. The sea chest cover as claimed in claim 1 wherein said water flow-through component is a cover body connectable to said perimeter component and wherein said cover body includes a plurality of perforations.

9. The sea chest cover as claimed in claim 8 wherein said first viscoelastic material and said second viscoelastic material are the same, and wherein said cover body and said perimeter component are fabricated as a unitary sea chest cover.

10. The sea chest cover as claimed in claim 9 wherein said unitary sea chest cover is fabricated of polyethylene.

11. The sea chest cover as claimed in claim 1 further comprising means for connecting said perimeter component to said hull of said ship.

12. The sea chest cover as claimed in claim 11 wherein said means for connecting said perimeter component to said hull of said ship are screws fabricated of a third viscoelastic material, wherein said third viscoelastic material may be the same as said first viscoelastic material or said second viscoelastic material.

13. The sea chest cover as claimed in claim 1 wherein said water flow-through component includes a plurality of slats hingedly connected to said perimeter component.

14. The sea chest cover as claimed in claim 13 wherein said slats are designed to provide a smooth hydrodynamic profile.

15. A sea chest cover designed to permit water into and out of a sea chest of a ship hull, wherein water within said sea chest may be stagnant, said sea chest cover comprising:

a. perimeter component for removably connecting said sea chest cover to said ship hull, said perimeter component fabricated of one of either a polyurethane or a polyethylene; and b. a water flow-through component couplable to said perimeter component, said water flow-through component fabricated of the other of either said polyurethane or said polyethylene, wherein said perimeter component and said water flow-through component are fabricated in shapes designed to conform substantially with a profile of said ship hull where said sea chest is located.

16. A sea chest cover designed to permit water to enter and exit a sea chest of a ship hull, wherein water within said sea chest may be stagnant, said sea chest cover comprising:

a. a cover ring connectable to said ship hull, said cover ring fabricated of polyethylene;

b. a cover grate including a plurality of transverse rods and one or more longitudinal structural rods connected to said plurality of transverse rods, said transverse rods and said one or more structural rods fabricated of polyethylene; and c. a plurality of screws for connecting said cover ring to said hull, said plurality of screws fabricated of polyethylene, wherein said cover ring and said cover grate are fabricated in shapes designed to conform substantially with a profile of said ship hull where said sea chest is located.

* * * * *